US005381845A

United States Patent [19]

Ruggie et al.

[11] Patent Number: 5,381,845

[45] Date of Patent: Jan. 17, 1995

[54] PARTITION WALL PANEL SYSTEM

[75] Inventors: Mark A. Ruggie, Geneva; William J. Schultz, St. Charles, both of Ill.

[73] Assignee: Masonite Corporation, Chicago, Ill.

[21] Appl. No.: 68,993

[22] Filed: May 27, 1993

[51] Int. Cl.[6] ..... A47G 5/00

[52] U.S. Cl. ..... 160/135; 52/285.3

[58] Field of Search ..... 160/135, 351; 52/285.3, 52/584, 239, 284, 280

[56] References Cited

U.S. PATENT DOCUMENTS

| | | | |
|---|---|---|---|
| 791,405 | 5/1905 | Crandal | 52/285 |
| 1,246,585 | 11/1917 | Geraerdts | 52/285 |
| 3,362,731 | 1/1968 | Gasche et al. | 285/212 |
| 3,362,739 | 1/1968 | Staeger et al. | 287/20.92 |
| 3,466,777 | 9/1969 | Wistrand et al. | 52/285.3 X |
| 3,528,559 | 9/1970 | Miller | 211/178 |
| 4,008,553 | 2/1977 | Oliver | 52/584 |
| 4,101,231 | 7/1978 | Streib | 403/252 |
| 4,120,130 | 10/1978 | Puschkarski | 52/285 |
| 4,291,512 | 9/1981 | Walton | 52/282 |
| 4,326,365 | 4/1982 | Svensson | 52/285.3 X |
| 4,416,093 | 11/1983 | Salkeld et al. | 160/135 X |
| 4,443,911 | 4/1984 | Bannister | 160/135 X |
| 4,995,211 | 2/1991 | Malott | 52/584 X |
| 5,000,717 | 3/1991 | Pheiffer | 52/584 X |
| 5,193,603 | 3/1993 | Whisnant | 160/135 |

FOREIGN PATENT DOCUMENTS

| | | | |
|---|---|---|---|
| 939 | 3/1979 | European Pat. Off. | 52/584 |

*Primary Examiner*—Blair M. Johnson

*Attorney, Agent, or Firm*—Marshall, O'Toole, Gerstein, Murray & Borun

[57] ABSTRACT

A system for connecting partition wall panels includes at least two panels, each having substantially U-shape upper and lower frame members and multi-faced vertical frame members attached to the upper and lower frame pieces. The multi-faced frame members include three faces of substantially equal width, each face adapted to abut against one of three faces of a multi-faced frame member of a similar panel. A connecting clip engages the abutting faces of the frame members at either end thereof.

14 Claims, 5 Drawing Sheets

PARTITION WALL PANEL SYSTEM

BACKGROUND OF THE INVENTION

1. Field of the Invention

The invention relates generally to connected structural members and more particularly to partition wall panels and a system for connecting the same.

2. Description of Related Technology

In the design of an office partition wall system the following features are desirable: ease of assembly; ready arrangement into a variety of configurations; a minimum number of connecting parts which firmly hold the partition walls in place; and connecting parts which are not visible, or at least not readily noticed, once the office partition system is assembled.

The office partition wall systems and other systems for connecting structural members which are known in the art often do not deliver all the desirable features set forth above. Typically, wall partition systems which offer a variety of configurations include the drawback of also including a large number of assorted parts for interconnecting the wall panels. On the other hand, clamping devices such as those disclosed in Puschkarski, U.S. Pat. No. 4,120,130 (Oct. 17, 1978) provide for a wide range of clamping configurations between two connecting structures, but would be difficult to conceal, require rather intricate parts and may be difficult to assemble. Therefore such clamping devices may not be desirable for use in an office setting.

Partition wall systems which include fewer parts often do not allow for a wide variety of panel positions. For example, Oliver, U.S. Pat. No. 4,008,553 (Feb. 22, 1977) discloses interconnected wall panels which are oriented at right angles to one another and appear to be limited to an L- or T-shape, or a four corner arrangement. The panels disclosed in the Oliver patent include vertical, slotted frame members which are secured to identical vertical, slotted frame members of other panels by tubular connectors having slots adapted to interfit with the slots of the frame members. It does not appear that the panels of the system disclosed in the Oliver patent could be successfully oriented in an end-to-end arrangement because the configuration of the tubular connectors and frame members require at least one right angle arrangement to provide adequate support for the panels being joined. Furthermore, the slots of each frame member and the slots of the connector must mate exactly to result in a secure attachment of the connecting panels.

SUMMARY OF THE INVENTION

It is an object of the invention to overcome one or more of the problems described above.

According to the invention, a partition wall panel system comprises at least two panels, each having a side upon which a frame member is attached. A planar face of the frame member of one of the panels is adapted to abut against any of a plurality of planar faces of the other panel. Means for attaching the panels at the abutting faces thereof also urge the panel faces toward one another.

Other advantages of the invention will be apparent to those skilled in the art from the following detailed description, taken in conjunction with the drawings and the appended claims.

DETAILED DESCRIPTION OF THE INVENTION

Figure 1:
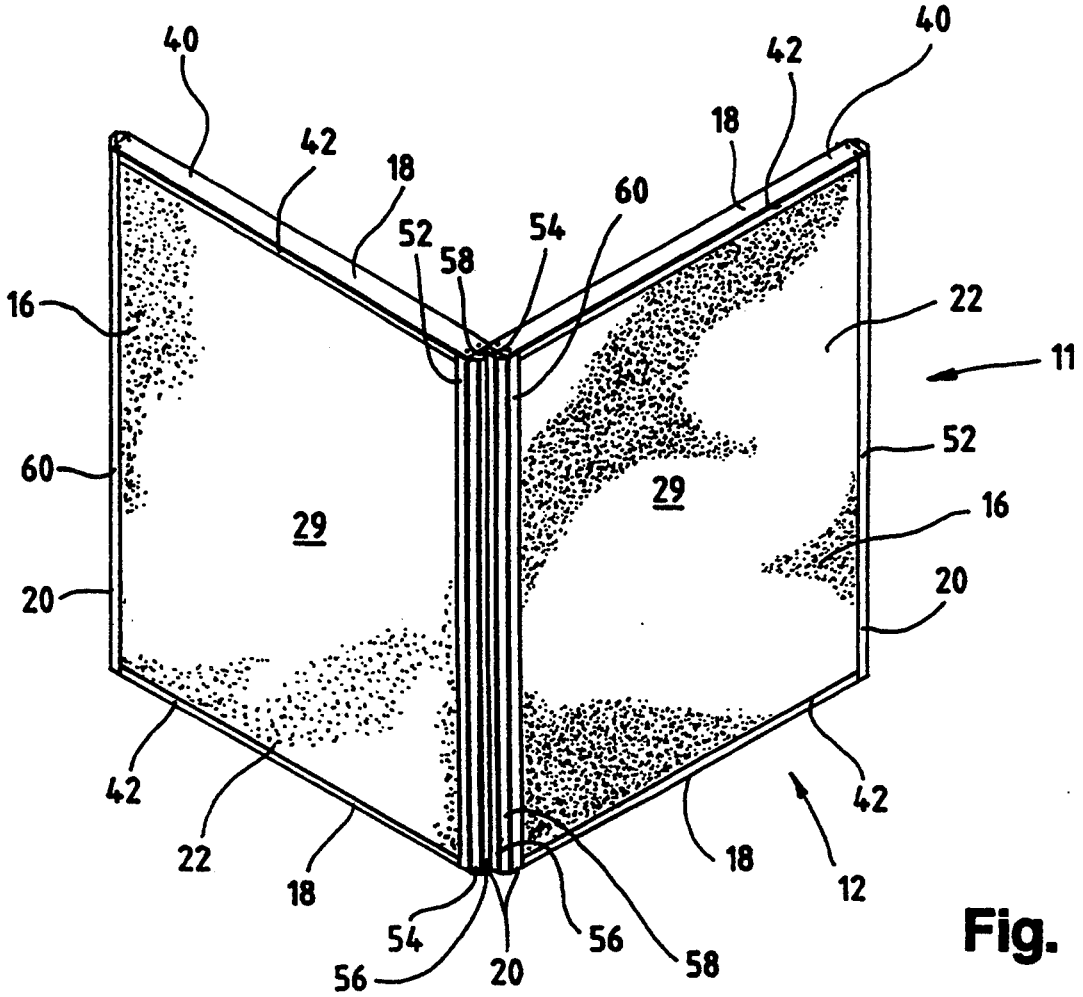
FIG. 1 is a perspective view of a panel system according to the invention showing an L-shape assembly of two panels.
Figure 2:
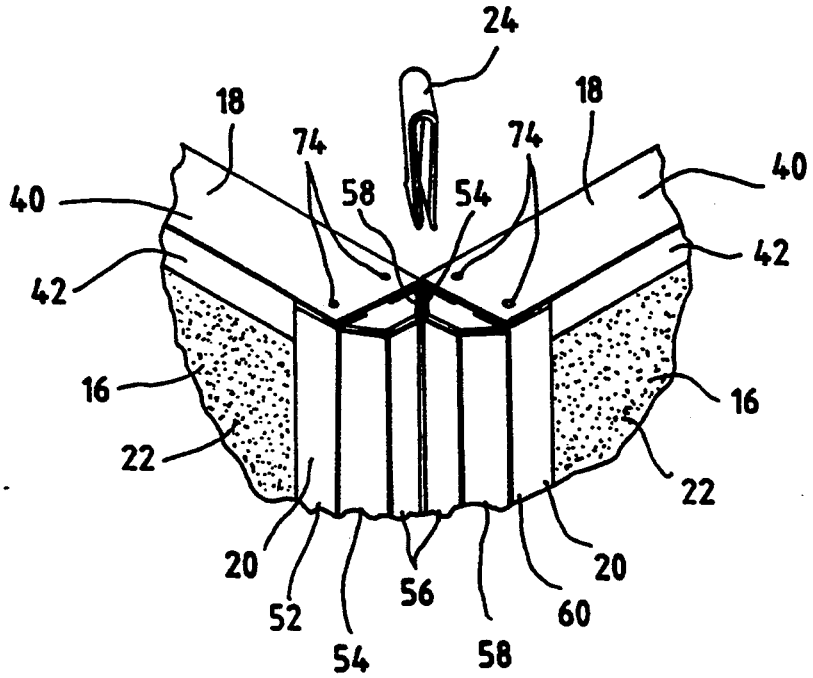
FIG. 2 is an enlarged and partially exploded perspective view of a portion of the panel system of FIG. 1 including a connecting clip.
Figure 5:
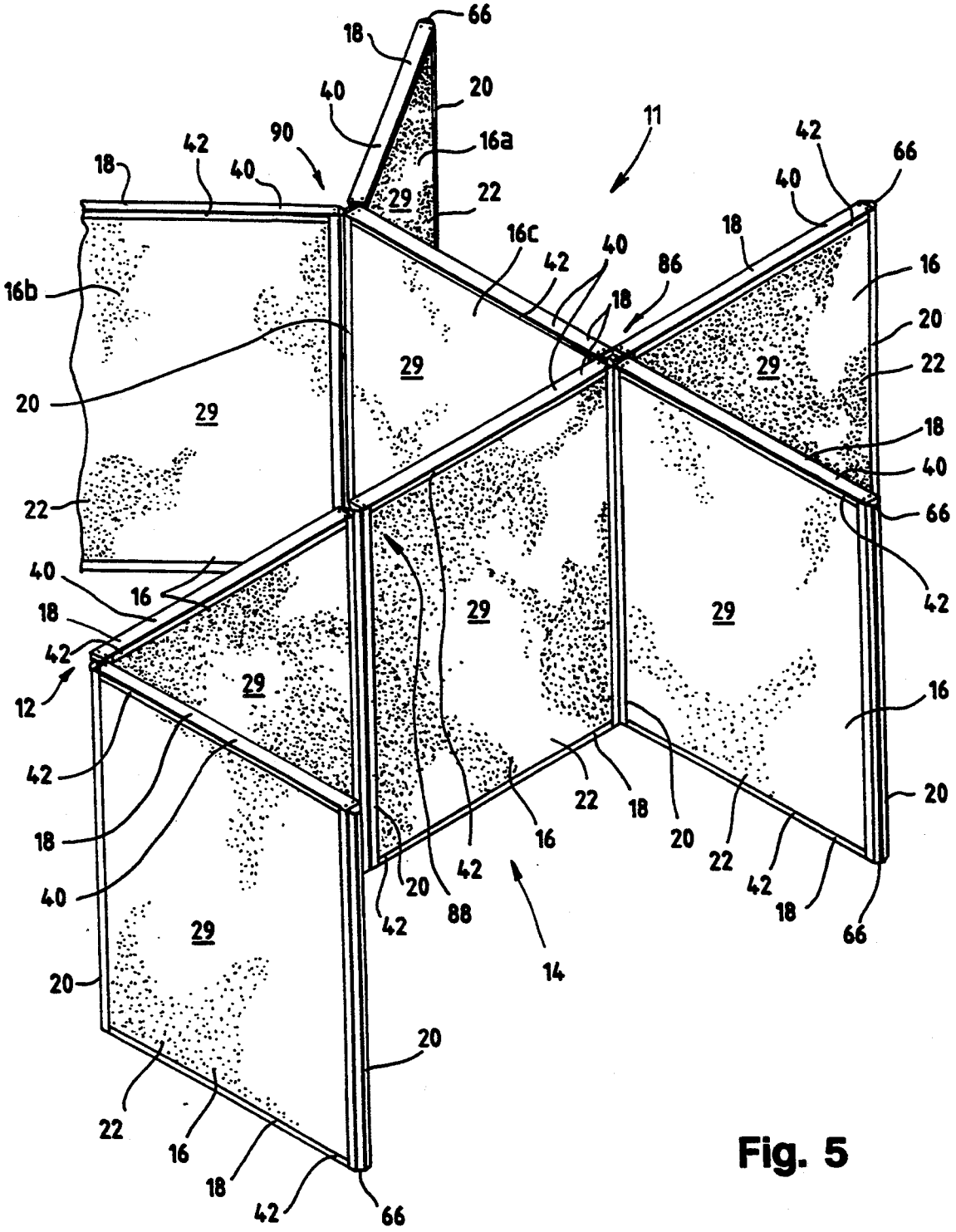
FIG. 5 is a perspective view of a panel system according to the invention showing an L-shape, a four-corner, a Y-shape and an end-to-end assembly of panels.
Figure 6:
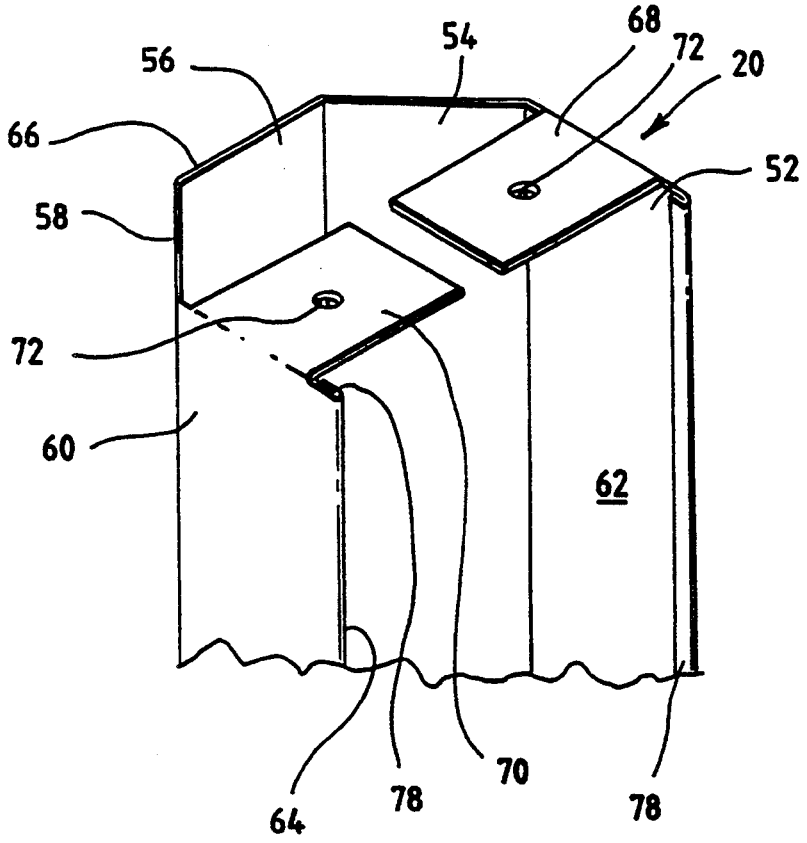
FIG. 6 is an enlarged and partial perspective view of one of the multi-faced frame members shown in FIG. 3.
Figure 9:
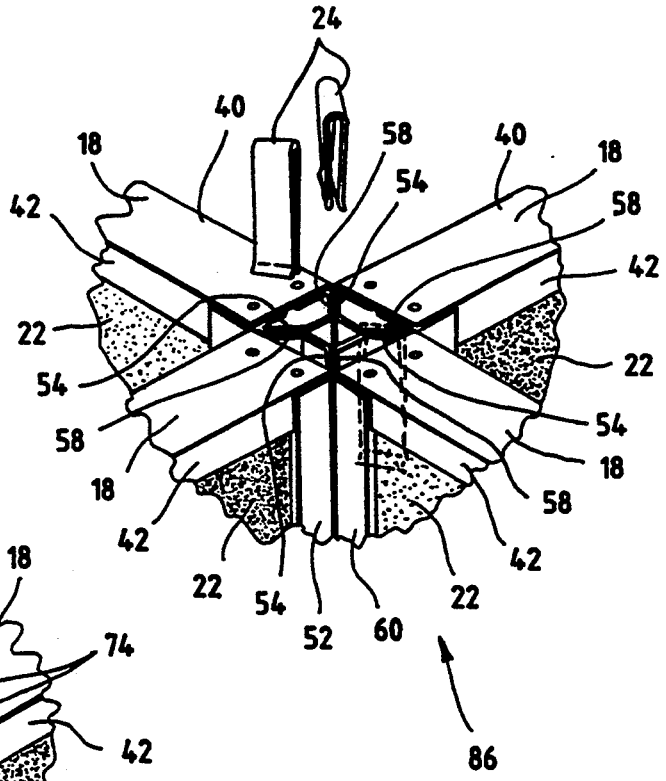
FIG. 9 is an enlarged and partially exploded perspective view of the four-corner assembly of panels shown in FIG. 5.
Figure 10:
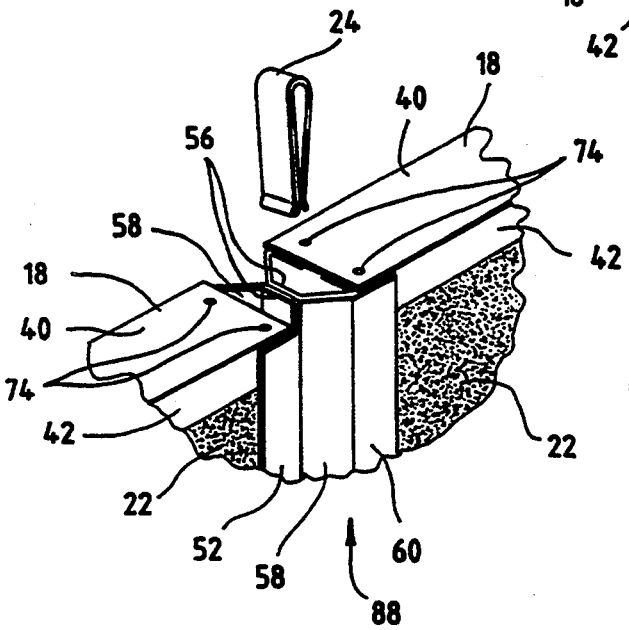
FIG. 10 is an enlarged and partially exploded perspective view of the end-to-end assembly of the panels shown in FIG. 5.

A partition wall panel system generally designated 11 according the invention is shown in FIGS. 1 and 5, which illustrate partition wall panel orientations generally designated 12 and 14, respectively. The inventive system 11 comprises a plurality of panels 16, each associated with substantially flat frame members 18 and multi-faced frame members 20 mounted on a panel body 22. As shown in FIGS. 2, 9 and 10, the panels 16 are attached to one another with connecting clips 24.

Figure 3:
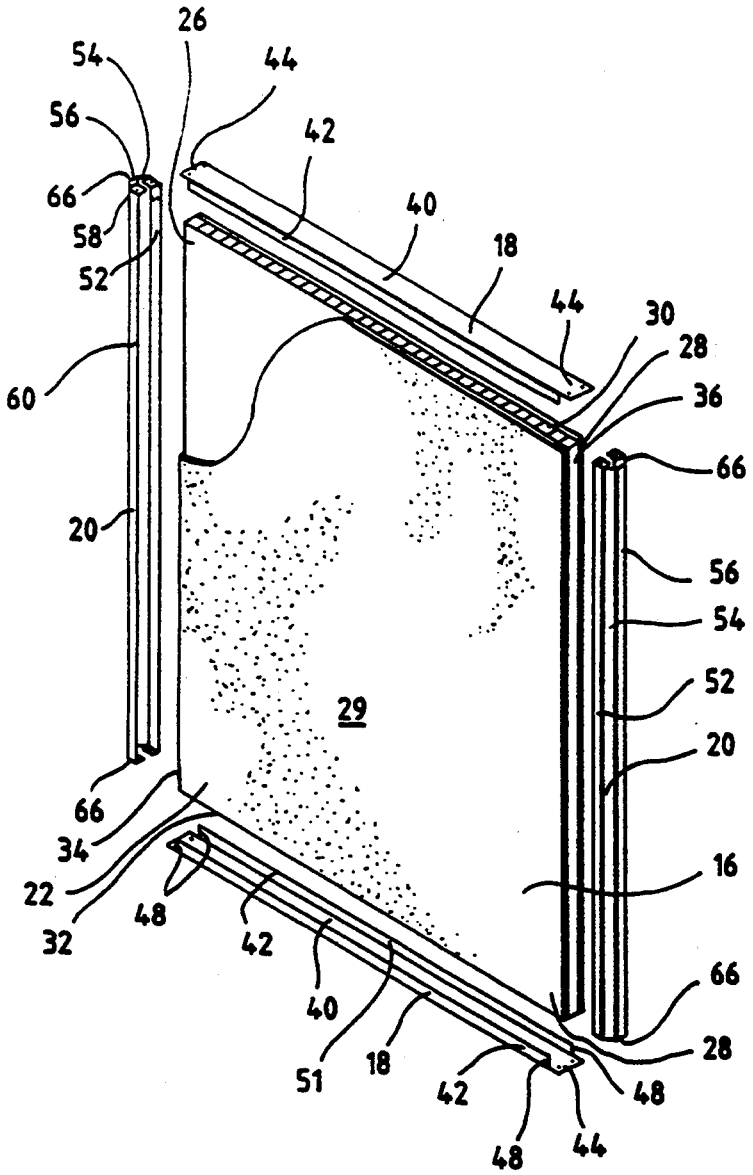
FIG. 3 is an exploded perspective view of one of the panels of the panel system shown in FIG. 1 including a panel core, multi-faced frame members and flat frame members.

FIG. 3 shows one of the panels 16 which is representative of each panel 16 making up the system 11 of the invention. The panel body 22 illustratively has a panel core 26 laminated to an inner surface (not shown) of each of two outer panel layers 28, each layer 28 having an outer surface or face 29. The panel core 26 and the layers 28 may be made of any material suitable for panel construction, such as wood or plastic. The layers 28 may also be made of various fabrics, metallic laminates, high pressure laminates, low pressure laminates, printed paper laminates, grain veneers and decorative plastic sheets. The panel layers 28 may also be decorative coatings such as multi-color spatters, metallic flecks, printed patterns, high and low gloss solid colors and flock coatings. Preferably, the panel core 26 has a honeycomb structure which has less mass than a solid panel yet exhibits adequate wall strength and sound absorption characteristics. Although not shown, the panel body 22 may also be of single, solid construction.

Figure 4:
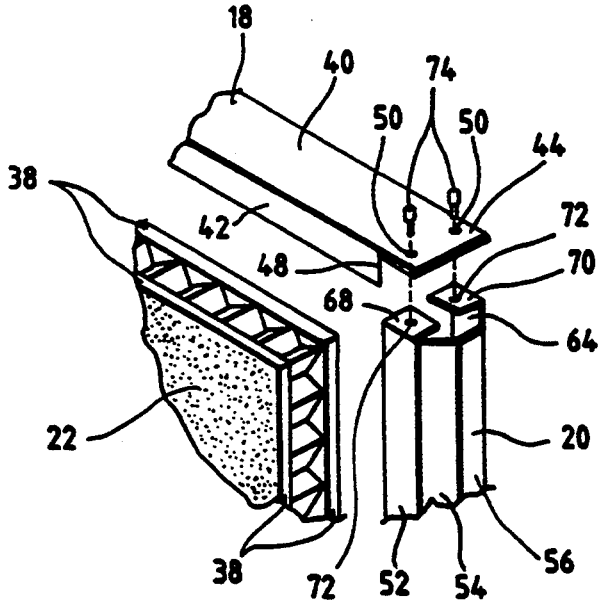
FIG. 4 is an enlarged and exploded perspective view of a portion of the panel shown in FIG. 3.

The panel body 22 includes two sides 30 and 32 which intersect with two substantially parallel sides 34 and 36. Preferably, the panel body 22 is substantially rectangular in shape with the two sides 30 and 32 being parallel and oriented perpendicular to the sides 30 and 32. As shown in FIGS. 3 and 4, each of the sides 30, 32, 34 and 36 preferably further includes generally parallel edges 38 of the outer panel layers 28.

Two of the flat frame menders 18 are mounted on the panel body 22 at the sides 30 and 32 and two of the multi-faced frame members 20 are mounted on the panel body 22 at the sides 34 and 36. When the panel 16 is utilized in a panel arrangement of the panel system 11, the frame members 18 and 20 abut against and cover the edges 38 with the flat frame members 18 oriented substantially horizontally and the multi-faced frame members 20 oriented substantially vertically. The frame members 18 and 20 are made from any suitably strong material such as metal or plastic with preferred materials being roll-formed steel, roll-formed aluminum, extruded plastic or extruded aluminum. Roll-formed steel is particularly preferred.

Figure 7:
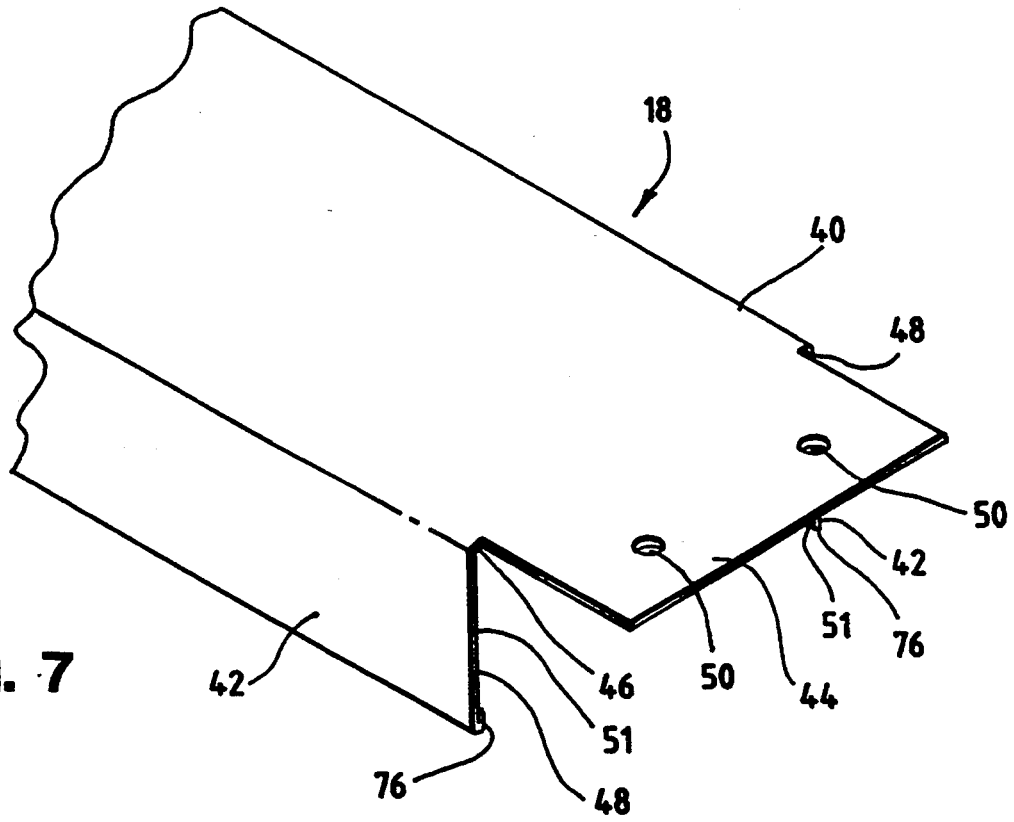
FIG. 7 is an enlarged and partial perspective view of one of the flat frame members shown in FIG. 3.
Figure 8:
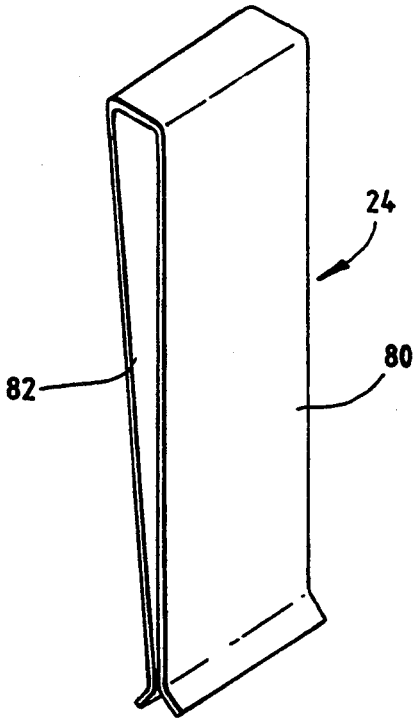
FIG. 8 is an enlarged perspective view of the connecting clip shown in FIG. 2.

With reference to FIGS. 3, 4 and 7, each flat frame member 18 of the panel 16 is of a squared-off U-shape and includes a main section 40 and substantially parallel support sections 42 integral with the section 40 and oriented substantially perpendicularly thereto. The main frame section 40 includes substantially identical support projections 44 located at either end 46 thereof. The support projections 44 are integral to the main section 40 and extend past edges 48 of each of the support sections 42. Each support projection 44 has two spaced fastener-receiving apertures 50.

The main frame section 40 has a width slightly greater than the width of the panel sides 30 and 32. When the frame mender 18 is mounted on the panel body 22, the main frame section 40 abuts against one of the sides 30 and 32 and an inner surface 51 of each of the support sections 42 contacts one of the faces 29 resulting in frictional engagement of the frame member 18 to the panel body 22. Although not required, the inner surfaces 51 of the support sections 42 may be adhered or otherwise fixed to the faces 29.

Each multi-faced frame member 20 of the panel 16 includes at least three faces, each adapted to abut against a face of the frame member 20 of another panel 16. Preferably, the faces are of substantially the same width. The panels 16 shown in the drawings have multi-faced frame members 20, each having five faces 52, 54, 56, 58 and 60 with the faces 54, 56 and 58 being of substantially equal width and each adapted for being adjoined to and abutted against one of the faces 54, 56 or 58 of the multi-faced frame member 20 of another panel 16. When mounted on a panel body 22, inner surfaces 62 and 64 of the faces 52 and 60, respectively, abut against the faces 29 resulting in frictional engagement of the frame member 20 to the panel body 22. Although not required, the inner surfaces 62 and 64 may also be adhered or otherwise fixed to the faces 29.

At each end 66 of the frame member 20, support projections 68 and 70 integral with and substantially perpendicular to the faces 52 and 60, respectively, extend substantially toward one another. Each of the support projections 68 and 70 has a bore 72 located substantially centrally thereon. When two frame menders 18 and two frame members 20 are mounted on the panel body 22, the bores 72 align with the bores 50 and fixing means in the form of rivets 74 or other fasteners are inserted through the aligned bores to securely attach the frame members 18 and 20 to each other and to the panel body 22. An advantage of the frame members 18 and 20 of the invention is that they may be mounted on the panel body 22 immediately after the outer layers 28 and the panel core 26 are glued and assembled, thereby functioning as a clamp during the drying of the glue.

Each of the frame members 18 and 20 preferably includes rolled edges 76 and 78 integral with the sections 42 and the faces 52 or 60, respectively.

With reference to FIGS. 2 and 8–10, the connecting clip 24 is preferably a Tinnerman-type spring clip adapted for attaching two of the panels 16 at either end 66 of the frame members 20. The clip 24 has legs 80 and 82 which when mounted on adjacent panels 16 urges one of the faces 54, 56 or 58 of the frame 20 against the abutting face 54, 56 or 58 of the adjacent frame 20.

As shown in FIGS. 1 and 5, the shape of the frame members 20 allows for a variety of panel-to-panel orientations. In particular, with reference to FIGS. 1 and 2, two panels 16 are arranged to form an L-shape or right-angle orientation 12 by abutting the face 54 of the frame member 20 of one of the panels 16 against the face 58 of the frame member 20 of the other panel 16. One connecting clip 24 is then placed at each end 66 with the leg 80 contacting an inner surface of the face 54 and the leg 82 contacting an inner surface of the face 58, the legs 80 and 82 urging the faces 54 and 58 toward one another.

With reference to FIG. 5, the panel orientation 14 includes a variety of panel configurations including an L-shape configuration 12, an X-shape or four-corner configuration 86, an end-to-end configuration 88 and a Y-shape configuration 90. With particular reference to FIG. 9, the four-corner configuration 86 is formed by placing four panels 16 at substantially right-angles to one another and abutting each face 54 of each frame member 20 against the face 58 of the frame member 20 of the adjacent panel 16 oriented at a right angle thereto. Four connecting clips 24 are then placed at the ends 66 with each leg 80 of each clip 24 contacting an inner surface of the face 54 and the leg 82 contacting an inner surface of the abutting face 58, the legs 80 and 82 of each clip 24 urging the abutting faces 54 and 58 toward one another.

A T-shape configuration (not shown) of the panel system 11 according to the invention may be formed by abutting the faces 54 and 58 of the frame members 20 of three panels 16 in the manner described above.

With reference to FIGS. 5 and 10, two panels are disposed in an end-to-end configuration 88 by abutting the faces 56 of two frame members 20 against one another and attaching the faces 56 at each of the ends 66 with one of the connecting clips 24, with the legs 80 and 82 of the clip 24 contacting the inner surfaces of the faces 56 and urging the abutting faces 56 toward one another.

With reference to FIG. 5, three panels are arranged in the Y-shape configuration 90 by abutting the faces 56 of the frame members 20 of first and second panels **16*a* and 16*b*, respectively, against the faces 54 and 58 of the frame member 20 of a third panel 16*c*, forming obtuse angles between the third panel 16*c* and each of the first and second panels, 16*a* and 16*b*, respectively. Two connecting clips 24 are mounted at each of the ends 66 with the first connecting clip urging the face 56 of the frame member 20 of the first panel 16*a* against the face 54 of the frame member 20 of the third panel 16*c* and the second connecting clip urging the face 56 of the frame member 20 of the second panel 16*b* against the face 58 of the frame member 20 of the third panel 16*c***.

After the panels are arranged in a desired orientation and the connecting clips 24 are mounted thereon, end caps (not shown), preferably made from plastic, may be mounted on the panel system 11 at the ends 66 to protect and conceal the ends 66 and the clips 24.

An advantage of the inventive system 11 is that each panel 16, regardless of width requires at maximum two clips 24 and two end caps to result in a finished panel which may cooperate with other panels 16 in a variety of configurations.

The foregoing detailed description is given for clearness of understanding only, and no unnecessary limitations are to be understood therefrom, as modifications within the scope of the invention will be apparent to those skilled in the art.

We claim:

1. A partition wall panel system comprising:

first and second panels, each having a side;

first and second frame members attached to the sides of the first and second panels, respectively, the first frame member having a first planar face and the second frame member having at least three substantially planar faces, the first face being adapted to abut against any of the faces of the second frame member;

means for attaching said first face to any abutting face of the second frame member wherein the means is adapted to urge the first face toward the abutting face.

2. The panel system according to claim 1 wherein the attaching means comprises a spring clip having first and second legs adapted to urge the first face toward the abutting face.

3. The panel system according to claim 1 wherein the first frame member comprises a plurality of faces, each adapted to abut against any of the faces of the second frame member.

4. The panel system according to claim 1 wherein the first face and the at least three faces of the second frame member are of substantially the same width.

5. The panel system according to claim 1 wherein the at least three faces of the second frame member includes second and third adjoining faces, the first face being adapted to abut against the second face to form a substantially right-angle configuration of the first and second panels and the first face being adapted to abut against the third face to form an obtuse angle between the first and second panels.

6. The panel system according to claim 5 wherein the first frame member includes a fourth face adjoining the first face, the fourth face being adapted to abut against the third face to form an end-to-end configuration of the first and second panels.

7. A partition wall panel system having at least two panels, each panel comprising:

a substantially rectangular panel body having first and second substantially parallel sides;

first and second frame members contacting the first and second sides, respectively, each of the frame members having at least three substantially planar faces of substantially equal width;

means adapted to attach to and urge any one of the faces toward an abutting face of another panel of the system.

8. A panel system according to claim 7 wherein the attaching means comprises a spring clip.

9. A panel system according to claim 7 wherein the panel body comprises first and second outer layers covering a panel core and further comprising:

third and fourth parallel sides substantially perpendicular to the first and second sides;

third and fourth frame members contacting the third and fourth sides, respectively, each of the third and fourth frame members being attached to the first and second frame members and wherein the first, second, third and fourth frame members clamp the first and second outer layers to the panel core.

10. A partition wall panel system comprising:

a plurality of like panels, each panel having substantially horizontally oriented first and second sides and substantially vertically oriented third and fourth sides;

first and second substantially flat frame members abutting the first and second sides, respectively;

first and second multi-faced frame members abutting the third and fourth sides, respectively, and being attached to the first and second flat frame members, each multi-faced frame member having substantially planar first, second and third faces of substantially equal width, the first face being integral with the second face and the second face being integral with the third face;

means adapted to attach to and urge any one of the first, second and third faces toward one of an abutting first, second and third face of another panel according to the system.

11. The panel system according to claim 10 wherein the attaching means comprises a spring clip.

12. The panel system according to claim 10 comprising first, second and third panels wherein the first and third faces of the first multi-faced frame member of the first panel abuts against the second face of the first multi-faced frame member of the second and third panels, respectively, forming a Y-shape arrangement of the first, second and third panels.

13. The panel system according to claim 10 comprising first, second, third and fourth panels wherein the first face of the first multi-faced frame member of each of the first and second panels abuts against the third face of the first multi-faced frame member of each of the third and fourth panels, forming a four-corner arrangement of the first, second, third and fourth panels.

14. The panel system according to claim 10 comprising first and second panels wherein the second face of the first multi-faced frame member of the first panel abuts against the second face of the first multi-faced frame member of the second panel forming an end-to-end arrangement of the first and second panels.

* * * * *